US010093451B2

(12) United States Patent
Blitz

(10) Patent No.: US 10,093,451 B2
(45) Date of Patent: Oct. 9, 2018

(54) TANK SUPPORT BASE

(71) Applicant: R AND D ENTERPRISES OF GULF REGION INC, New Orleans, LA (US)

(72) Inventor: Jason W. Blitz, New Orleans, LA (US)

(73) Assignee: R AND D ENTERPRISES OF GULF REGION INC, New Orleans, LA (US)

( * ) Notice: Subject to any disclaimer, the term of this patent is extended or adjusted under 35 U.S.C. 154(b) by 131 days.

(21) Appl. No.: 15/257,560

(22) Filed: Sep. 6, 2016

(65) Prior Publication Data

US 2017/0144795 A1 May 25, 2017

Related U.S. Application Data

(60) Provisional application No. 62/213,987, filed on Sep. 3, 2015.

(51) Int. Cl.

*B65D 19/44* (2006.01)
*B65D 71/00* (2006.01)
*B65D 19/00* (2006.01)

(52) U.S. Cl.

CPC ..... *B65D 19/44* (2013.01); *B65D 19/0089* (2013.01); *B65D 71/0096* (2013.01); *B65D 2519/00273* (2013.01); *B65D 2519/00293* (2013.01); *B65D 2519/00323* (2013.01); *B65D 2519/00442* (2013.01); *B65D 2519/00815* (2013.01)

(58) Field of Classification Search

CPC .... B65D 19/44; B65D 19/0089; B65D 19/00; B65D 71/0088; B65D 71/0092; B65D 71/0096; B65D 2519/00273; B65D 2519/00293; B65D 2519/00323; B65D 2519/00442; B65D 2519/00815

USPC ..... 206/386; 220/1.5; 108/55.1

See application file for complete search history.

(56) References Cited

U.S. PATENT DOCUMENTS 6,915,815 B1 7/2005 Ness
6,983,704 B1 1/2006 Ness
(Continued)

OTHER PUBLICATIONS

PCT International Search Report and Written Opinion dated Jan. 24, 2017; International Application No. PCT/US2016/050471.

*Primary Examiner* — Andrew Perreault
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A tank support base and skid apparatus provides a frame having upper and lower end portions, left and right side portions and front and rear portions. The upper end portion has a front row of tank receptive supports and a back row of tank receptive supports. A frame floor is spaced vertically below the tank receptive support. The frame has a peripheral fluid barrier that includes a front wall, a rear wall and side walls that form the fluid barrier around the floor, each side wall extending from the floor to a tank receptive support. First and second internal support members span from one side of the frame to the other side of the frame and each spaced between the front wall and the rear wall. Each tank receptive support includes horizontal beams that span from the front wall to the rear wall and supported by the internal support members vertical members that each connect with a horizontal beam. Inclined plates each connect to both a horizontal beam and a vertical member. Stops mounted on the beams separate a tank receptive support of the first row with a tank receptive support of the back row.

22 Claims, 20 Drawing Sheets

(56) References Cited

U.S. PATENT DOCUMENTS

| | | | |
|---|---|---|---|
| 7,520,707 | B1 | 4/2009 | Ness |
| 7,552,687 | B1 | 6/2009 | Ness |
| 7,997,214 | B1 | 8/2011 | Ness |
| 8,079,791 | B2 | 12/2011 | Ness |
| 8,104,501 | B1 | 1/2012 | Ness |
| 8,231,316 | B2 | 7/2012 | Ness |
| 8,336,450 | B1 | 12/2012 | Ness |
| 8,490,552 | B2 | 7/2013 | Ness |
| 8,506,219 | B2 | 8/2013 | Ness |
| 8,826,832 | B2 | 9/2014 | Ness |
| 8,870,501 | B2 | 10/2014 | Ness |
| 8,875,894 | B2 | 11/2014 | Ness |
| 9,022,707 | B2 | 5/2015 | Ness |
| 9,027,596 | B2 | 5/2015 | Ness et al. |
| 9,061,822 | B2 | 6/2015 | Ness |
| 2009/0272666 | A1 | 11/2009 | Marcel |
| 2012/0074033 | A1 | 3/2012 | Sissons |

TANK SUPPORT BASE

CROSS-REFERENCE TO RELATED APPLICATIONS

This application claims benefit of U.S. Provisional Application Ser. No. 62/213,987, filed on 3 Sep. 2015, which is hereby incorporated herein by reference and priority of/to which is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the transportation of fluid holding tanks (sometimes referred to as "tote tanks") wherein a specially configured frame supports and separates multiple tanks arranged in a front row of tanks, a rear row of tanks, and has a floor and channel arrangement that catches any inadvertent spillage.

2. General Background of the Invention

Tanks are often used to transport volumes of chemicals to an offshore marine oil and gas well drilling platform. These tanks carry chemicals that would be dangerous to the environment if spillage occurs. Patents have issued for cargo racks that can be used to transport tanks or vessels filled with liquid. Examples are found in the following table, each listed patent hereby incorporated herein by reference:

TABLE 1

| U.S. Pat. No. | Title | Issue Date MM-DD-YYYY |
|---|---|---|
| 6,915,815 | Apparatus for Storing and Dispensing Oil and Gas Well Drilling Fluids | Jul. 12, 2005 |
| 6,983,704 | Offshore Cargo Rack for Use in Transferring Palletized Loads Between a Marine Vessel and an Offshore Platform | Jan. 10, 2006 |
| 7,520,707 | Bulk Bag Transport Apparatus | Apr. 21, 2009 |
| 7,552,687 | Offshore Cargo Rack for Use in Transferring Palletized Loads Between a Marine Vessel and An Offshore Platform | Jun. 30, 2009 |
| 7,997,214 | Offshore Cargo Rack for Use in Transferring Palletized Loads Between a Marine Vessel and An Offshore Platform | Aug. 16, 2011 |
| 8,079,791 | Bulk Bag Transport Apparatus | Dec. 20, 2011 |
| 8,104,501 | Fluid Handling System | Jan. 31, 2012 |
| 8,231,316 | Offshore Cargo Rack for Use in Transferring Fluid Holding Tank Loads Between a Marine Vessel and an Offshore Platform | Jul. 31, 2012 |
| 8,336,450 | Ice Jacketed Cooking Pot | Dec. 25, 2012 |
| 8,490,552 | Offshore Cargo Rack for Use in Transferring Palletized Loads Between a Marine Vessel and An Offshore Platform | Jul. 23, 2013 |
| 8,506,219 | Offshore Cargo Rack for Use in Transferring Fluid Holding Tank Loads Between a Marine Vessel and an Offshore Platform | Aug. 13, 2012 |

TABLE 1-continued

| U.S. Pat. No. | Title | Issue Date MM-DD-YYYY |
|---|---|---|
| 8,826,832 | Offshore Cargo Rack for Use in Transferring Palletized Loads Between a Marine Vessel and An Offshore Platform | Sep. 9, 2014 |
| 8,870,501 | Offshore Cargo Rack for Use in Transferring Fluid Holding Tank Loads Between a Marine Vessel and An Offshore Platform | Oct. 28, 2014 |
| 8,875,894 | Offshore Cargo Rack for Use in Transferring Loads Between a Marine Vessel and an Offshore Platform | Nov. 4, 2014 |
| 9,022,707 | Offshore Cargo Rack for Use in Transferring Loads Between a Marine Vessel and an Offshore Platform | May 5, 2015 |
| 9,027,596 | Method and Apparatus for Handling Oil and Gas Well Drilling Fluids | May 12, 2015 |
| 9,061,822 | Offshore Cargo Rack for Use in Transferring loads Between a Marine Vessel and an Offshore Platform | Jun. 23, 2015 |

BRIEF SUMMARY OF THE INVENTION

The present invention provides an improved tank support base and skid apparatus that has particular utility in the transport of fluid holding tanks.

The apparatus provides a frame having upper and lower end portions, left and right side portions and front and rear portions.

The upper end portion has a front row of tank receptive supports and a back row of tank receptive supports.

A frame floor is spaced vertically below the tank receptive supports.

The frame has a peripheral fluid barrier that includes a front wall, a rear wall and side walls that form the fluid barrier around the floor, each side wall extending from the floor to a tank receptive support.

First and second internal support members span from one side of the frame to the other side of the frame and each spaced between the front wall and the rear wall (or between a side wall and another side wall). These internal support members can be parallel.

Each tank receptive support includes horizontal rails or beams that span from the front wall to the rear wall and are supported by the internal support members; vertical members that each connect with a horizontal rail or beam; and inclined plates that each connect to both a horizontal beam and a vertical member.

Stops can be mounted on the beams that separate a tank receptive support of the first row with a tank receptive support of the back row.

In one embodiment, the rails or horizontal beams enable a selected tank to be moved from one row to the other row by sliding the tank.

In one embodiment, inclined plates form an obtuse angle with the horizontal beams.

In one embodiment, forklift tine sockets can be positioned in between the upper and lower end portions of the frame and extending to the front wall.

In one embodiment, the optional stops each include opposed inclined surfaces that meet an apex edge.

In one embodiment, tubes at spaced apart intervals are each mounted in between two of the internal support members.

In one embodiment, hand rails are included that attach to the frame at the said tubes.

In one embodiment, the internal supports define a channel therebetween and the floor is inclined to direct fluid flow to the channel via flow openings.

In one embodiment, the apparatus comprises a valve that valves fluid flow from the channel to the exterior of the frame.

In one embodiment, there are multiple spaced apart openings in the internal supports at a position next to the floor.

In one embodiment, the forklift tine sockets extend from the front wall to the rear wall.

In one embodiment, the forklift tine sockets includes an upper panel that is at the same level as the horizontal beam.

In one embodiment, the forklift tine sockets include multiple plate sections surrounding an opening, said sections providing support to a tank placed on a receptacle that is located above the socket.

In one embodiment, both the stops and the inclined plates provide inclined, diagonally angled upper surfaces that each form an obtuse angle with a said horizontal beam.

In one embodiment, each vertical member has a cut out that is placed in between the front wall and an internal support.

In one embodiment, there are a plurality of fluid storage tanks on the frame, each tank on a tank receptive support.

In one embodiment, each tank has a lower end portion with discharge piping.

In one embodiment, each vertical member has a cut out that is placed in between the front wall and an internal support.

In one embodiment, each cutout is next to a tank discharge piping.

In one embodiment, each stop is preferably positioned above the internal support members.

In one embodiment, the present invention preferably further comprises forklift tine sockets in between the upper and lower end portions of the frame and extending to the front wall.

In one embodiment, the stops each preferably include opposed inclined surfaces that meet an apex edge.

In one embodiment, the present invention preferably further comprises tubes at spaced apart intervals each preferably mounted in between two of the internal support members.

In one embodiment, the present invention preferably further comprises hand rails that preferably attach to the frame at the tubes.

In one embodiment, said internal supports preferably define a channel therebetween and the floor is inclined to direct fluid flow to said channel.

In one embodiment, the present invention preferably further comprises a valve that preferably valves fluid flow from the channel to the exterior of the frame.

In one embodiment, the present invention preferably further comprises multiple spaced apart openings in the internal supports preferably at a position next to the floor.

In one embodiment, the forklift tine sockets preferably extend from the front wall to the rear wall.

In one embodiment, the forklift tine sockets preferably includes an upper panel that is at the same level as the horizontal beam.

In one embodiment, the forklift tine sockets preferably include multiple plate sections surrounding an opening, said sections preferably providing support to a tank placed on a receptacle that is located above the socket.

In one embodiment, both the stops and the inclined plates preferably provide inclined, diagonally angled upper surfaces that each form an obtuse angle with a said horizontal beam.

In one embodiment, each vertical member preferably has a cut out that is placed in between the front wall and an internal support.

In one embodiment, the present invention preferably further comprises a plurality of fluid storage tanks on the frame, each tank preferably on a tank receptive support.

In one embodiment, each vertical member preferably has a cut out that is placed in between the front wall and an internal support.

The present invention includes a tank support base and skid apparatus comprising a frame having upper and lower end portions, left and right side portions and front and rear portions. The upper end portion preferably has a front row of tank receptive supports and a back row of tank receptive supports. A frame floor is preferably spaced vertically below said receptive support. The frame preferably has a peripheral fluid barrier that includes a front wall, a rear wall and side walls that form the said fluid barrier around said floor, each said side wall extending from said floor to a said tank receptive support. First and second internal support members can preferably span from one side of said frame to the other side of said frame and each spaced between the front wall and the rear wall. Each tank receptive support preferably includes horizontal beams that span from the front wall to the rear wall and supported by the internal support members, vertical members that each connect with a horizontal beam, inclined plates that each connect to both a said horizontal beam and a said vertical member. Stops on the frame can be included to preferably prevent lateral movement of the tanks relative to the frame.

The present invention includes a tank support base and skid apparatus comprising a frame having upper and lower end portions, left and right side portions and front and rear portions and a frame periphery. The upper end portion preferably has a plurality of tank receptive supports. A frame floor can be preferably spaced vertically below said tank receptive supports. The frame preferably having a peripheral fluid barrier that includes a front wall, a rear wall and side walls that form the said fluid barrier around said floor, each said side wall extending from said floor to a said tank receptive support. First and second internal support members preferably span from one side of said frame to the other side of said frame. A channel is preferably in between the internal support members. Channel openings can preferably transmit any spilled fluid from the floor to the channel. Channel openings can preferably allow any spilled fluid from the floor to drain to the channel. Each tank receptive support preferably includes horizontal beams that preferably span from the front wall to the rear wall and supported by the internal support members, vertical members that each connect with a horizontal beam, inclined plates that each connect to both a said horizontal beam and a said vertical member.

In one embodiment, the present invention preferably further comprises dividers positioned above said internal support members.

In one embodiment, the present invention preferably further comprises forklift tine sockets in between the upper and lower end portions of the frame and extending to the front wall.

In one embodiment, the stops each preferably include opposed inclined surfaces that meet an apex edge.

In one embodiment, the present invention preferably further comprises tubes at spaced apart intervals each preferably mounted in between two said internal support members.

In one embodiment, the present invention preferably further comprises hand rails that preferably attach to the frame at the said tubes.

In one embodiment, said internal supports preferably define a channel therebetween and the floor is preferably inclined to direct fluid flow to said channel.

In one embodiment, the present invention preferably further comprises a valve that preferably valves fluid flow from the channel to the exterior of the frame.

In one embodiment, the present invention preferably further comprises multiple spaced apart openings in the internal supports at a position next to the floor.

In one embodiment, the forklift tine sockets preferably extend from the front wall to the rear wall.

In one embodiment, the forklift tine sockets preferably includes an upper panel that is at the same level as the horizontal beam.

In one embodiment, the forklift tine sockets preferably include multiple plate sections surrounding an opening, said sections preferably providing support to a tank placed on a receptacle that is located above the socket.

In one embodiment, both the dividers and the inclined plates preferably provide inclined, diagonally angled upper surfaces that each form an obtuse angle with a said horizontal beam.

In one embodiment, each vertical member preferably has a cut out that is placed in between the front wall and an internal support.

In one embodiment, the present invention preferably further comprises a plurality of fluid storage tanks on the frame, each tank on a tank receptive support.

In one embodiment, each vertical member preferably has a cut out that is placed in between the front wall and an internal support.

The present invention includes a tank support base and skid apparatus comprising a frame having upper and lower end portions, left and right side portions and front and rear portions. The upper end portion preferably has at least one row of tank receptive supports. A frame floor can be preferably spaced vertically below said receptive supports. The frame preferably has a peripheral fluid barrier that includes a front wall, a rear wall and side walls that form the said fluid barrier around said floor, each said side wall extending from said floor to a said tank receptive support. First and second internal support members preferably span across at least half of said frame. A channel is preferably in between the internal support members. Channel openings preferably transmit any spilled fluid from the floor to the channel. Each tank receptive support preferably includes horizontal beams that span from the front wall to the rear wall and preferably supported by the internal support members, vertical members that each preferably connect with a horizontal beam, inclined plates that each preferably connect to both a said horizontal beam and a said vertical member. Corners are preferably defined by a joint of a vertical member to an inclined plate that preferably prevent lateral movement of the tanks relative to the frame.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
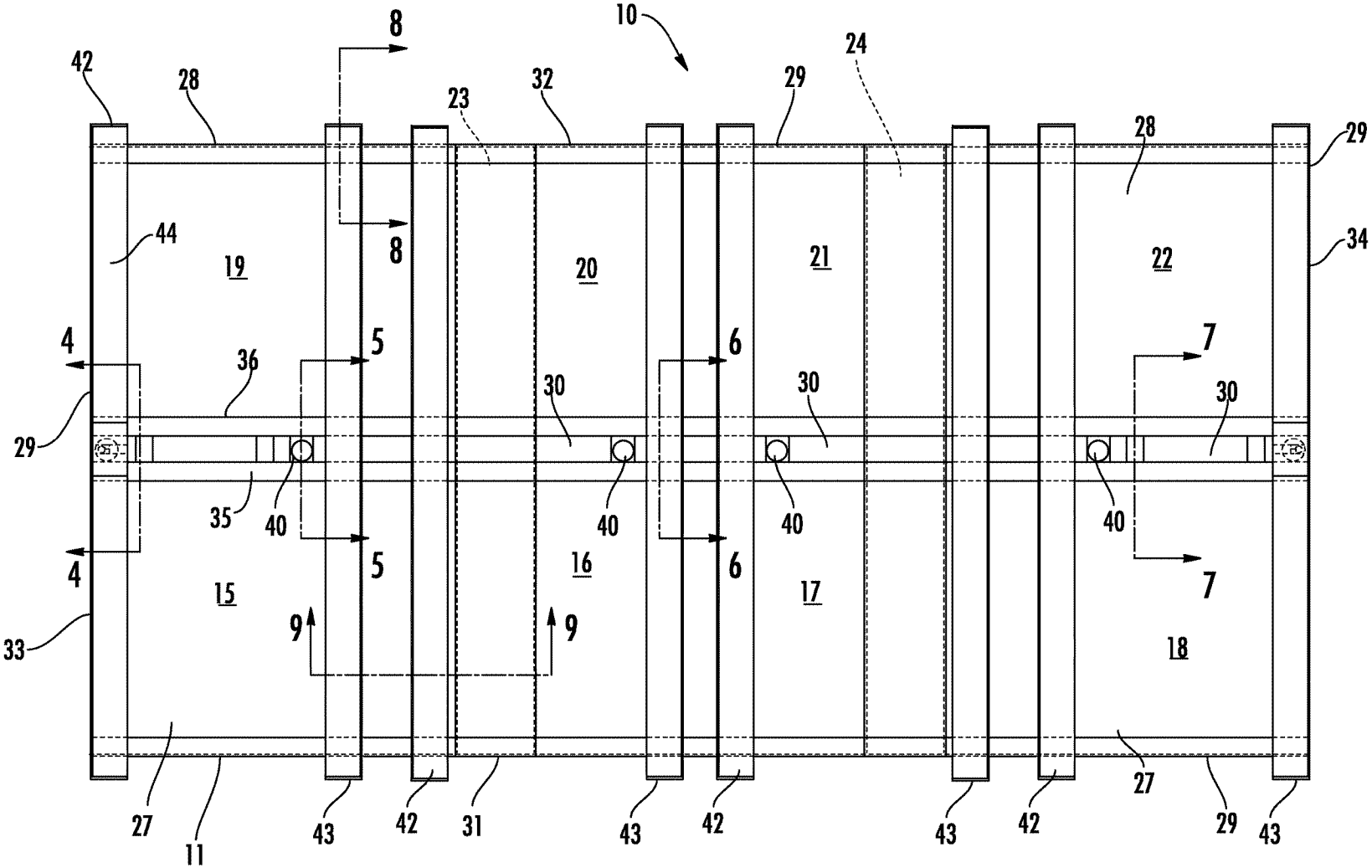
FIG. 1 is a top plan view of a preferred embodiment of the apparatus of the present invention.
Figure 2:
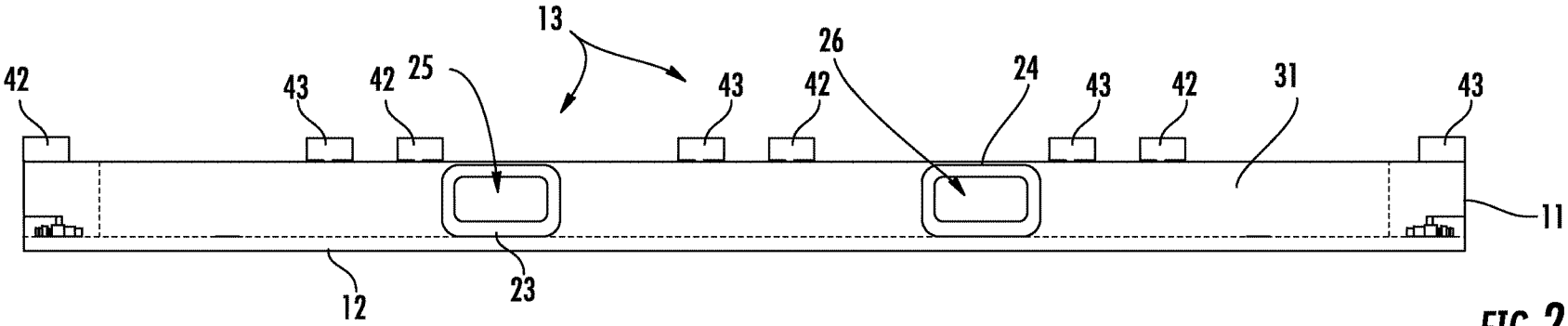
FIG. 2 is a front view of a preferred embodiment of the apparatus of the present invention.
Figure 3:
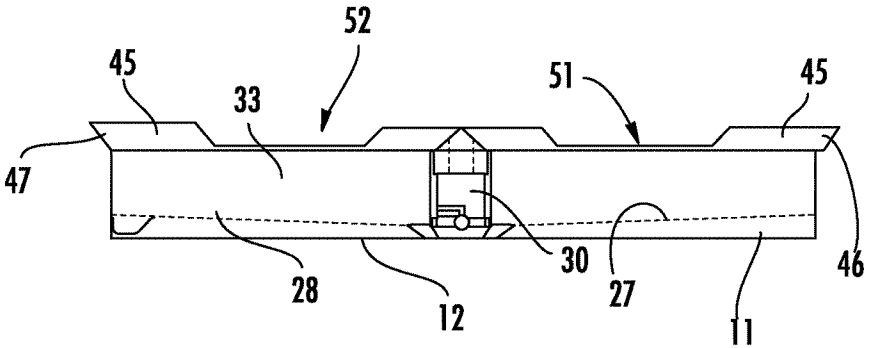
FIG. 3 is an end view of a preferred embodiment of the apparatus of the present invention.
Figure 4:
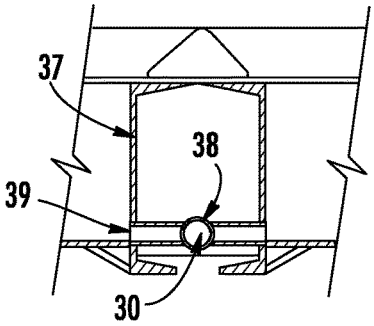
FIG. 4 is a sectional view taken along lines 4-4 of FIG. 1.

FIGS. 1-26 illustrate a preferred embodiment of the apparatus of the present invention generally designated by the numeral 10. In FIGS. 1-26, the tank support and transport skid apparatus 10 provides a frame 11 having a bottom 12 that preferably can be flat for resting upon a flat surface such as a concrete slab, earth surface, or offshore platform deck. Frame 11 provides upper area 13 that is preferably used to hold multiple (such as 8, for example) tanks 14. The tank support and transport skid apparatus 10 is preferably made out of channel iron, angle iron or other suitable material, and can have a length of about 16 feet (4.88 meters) and a width of about 8 feet 7.25 inches (2.62 meters).

Figure 10:
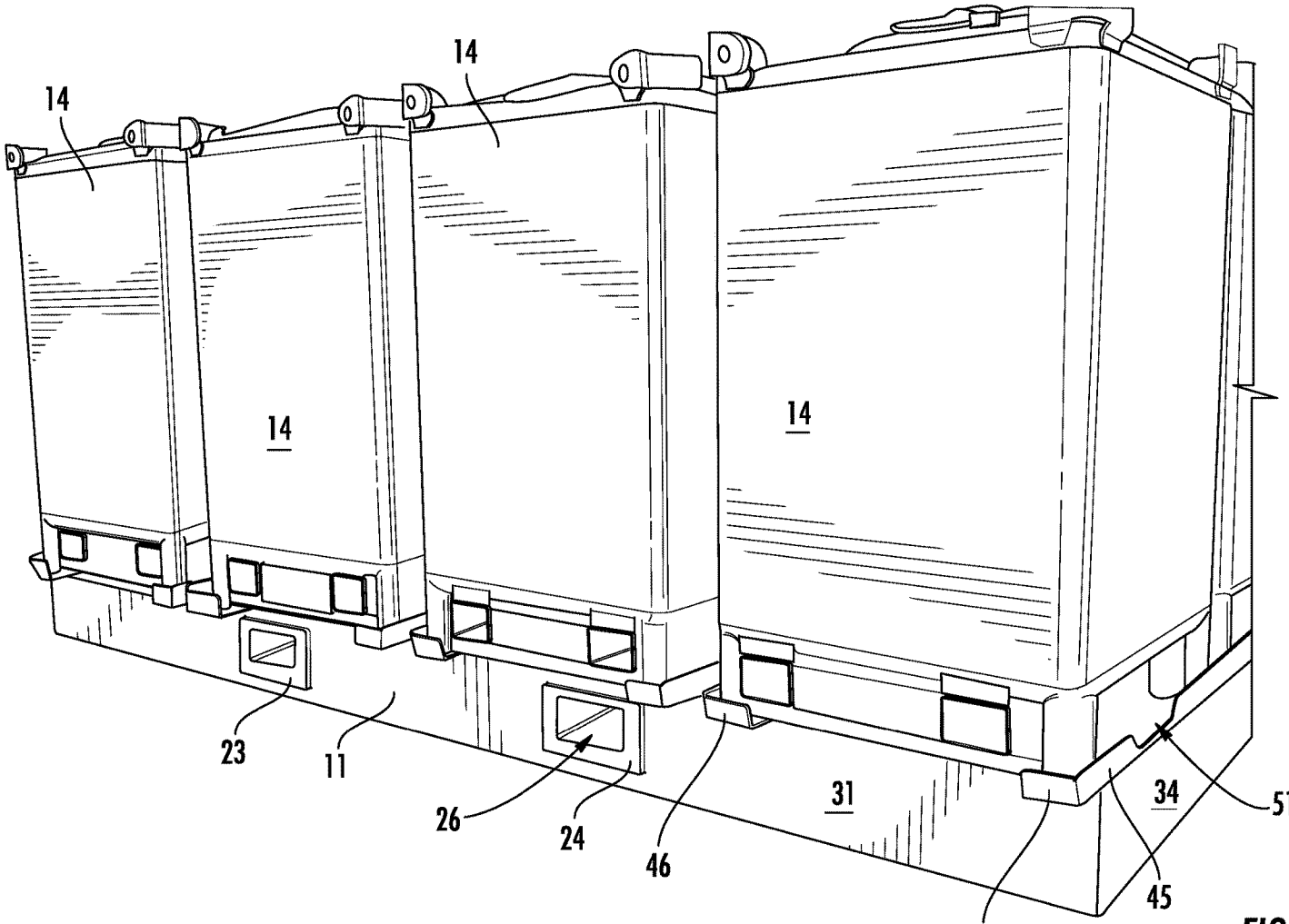
FIG. 10 is a partial perspective view of a preferred embodiment of the apparatus of the present invention.
Figure 14:
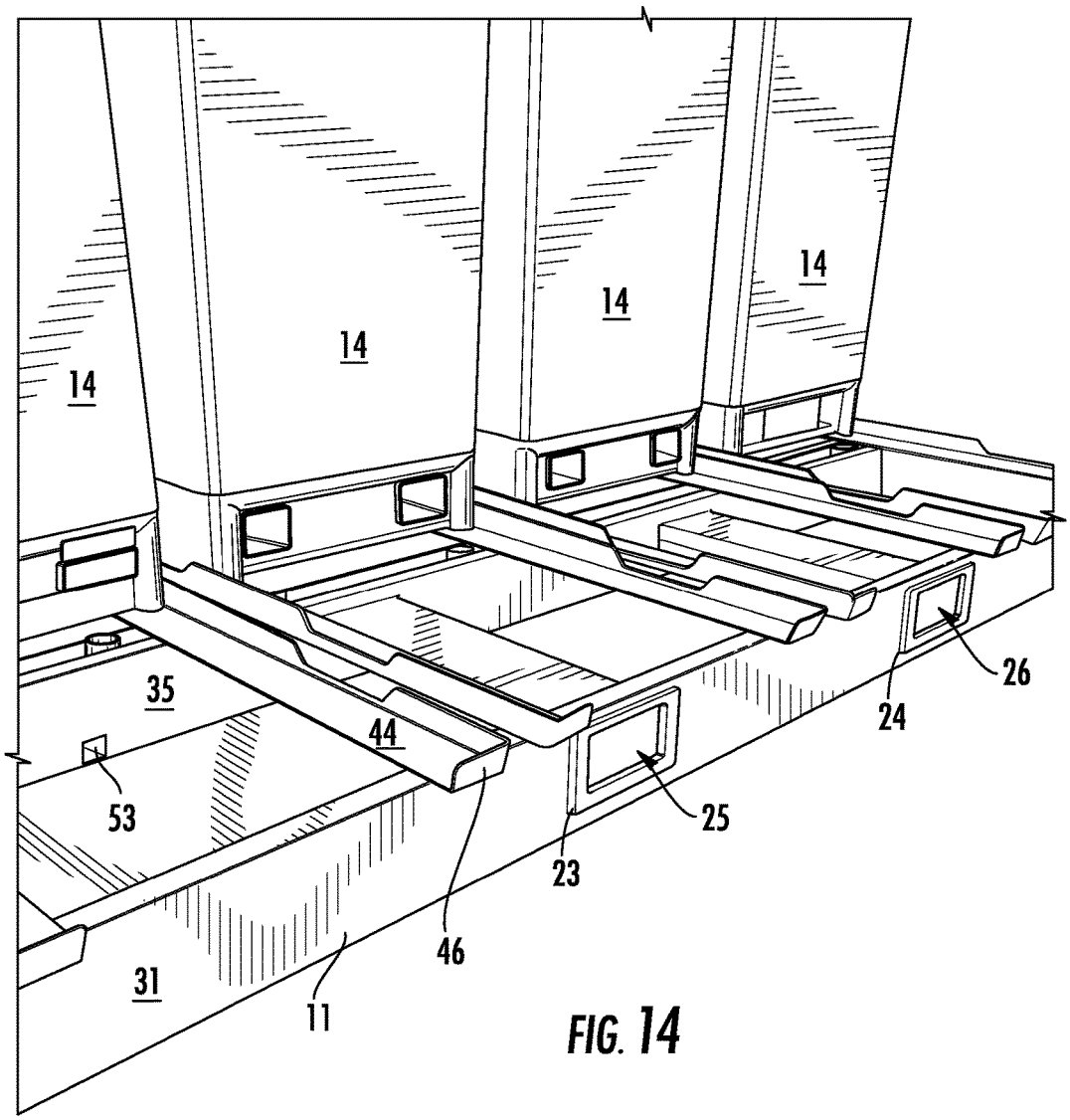
FIG. 14 is partial perspective view of a preferred embodiment of the apparatus of the present invention.
Figure 15:
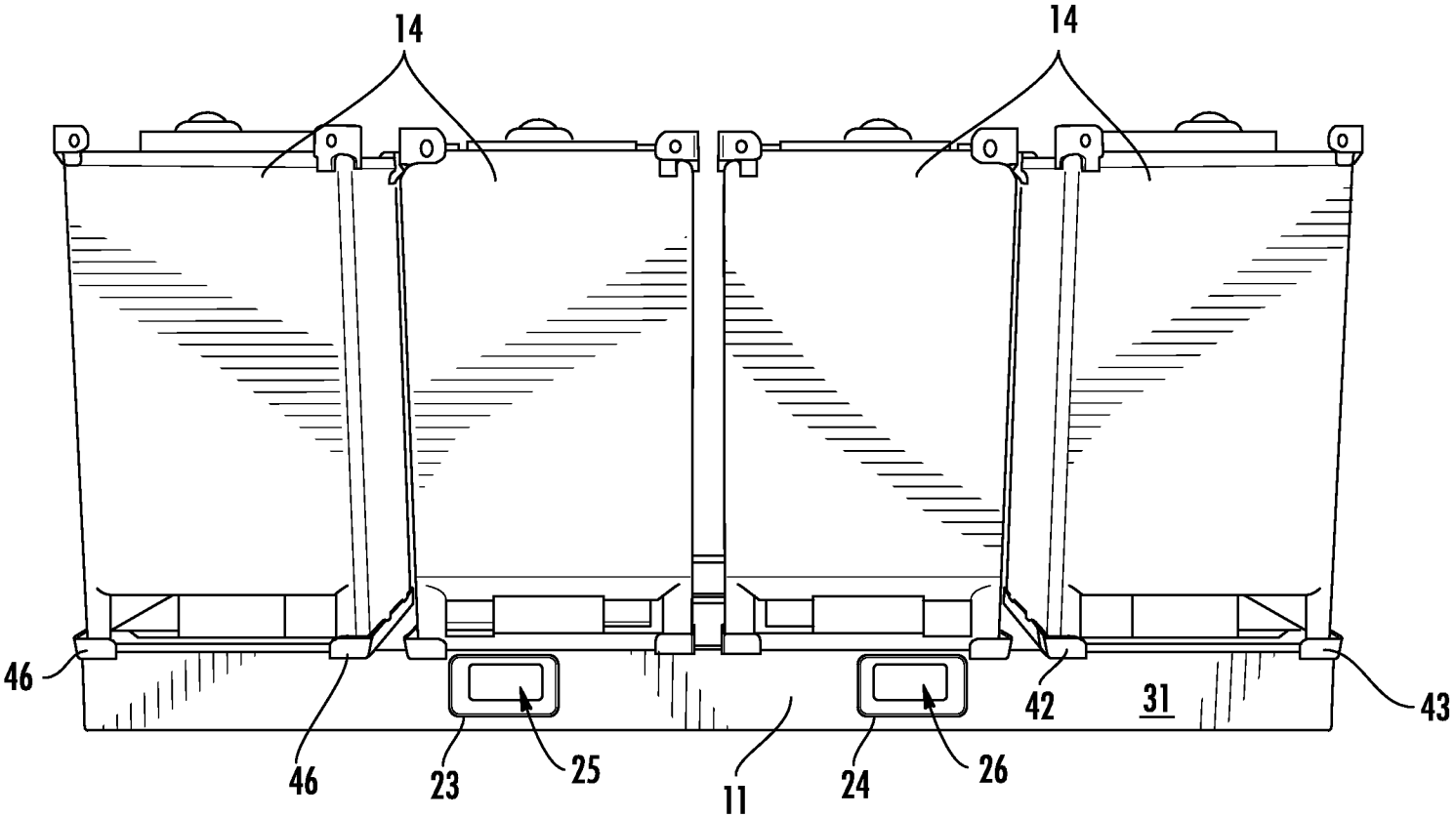
FIG. 15 is perspective view of a preferred embodiment of the apparatus of the present invention.
Figure 16:
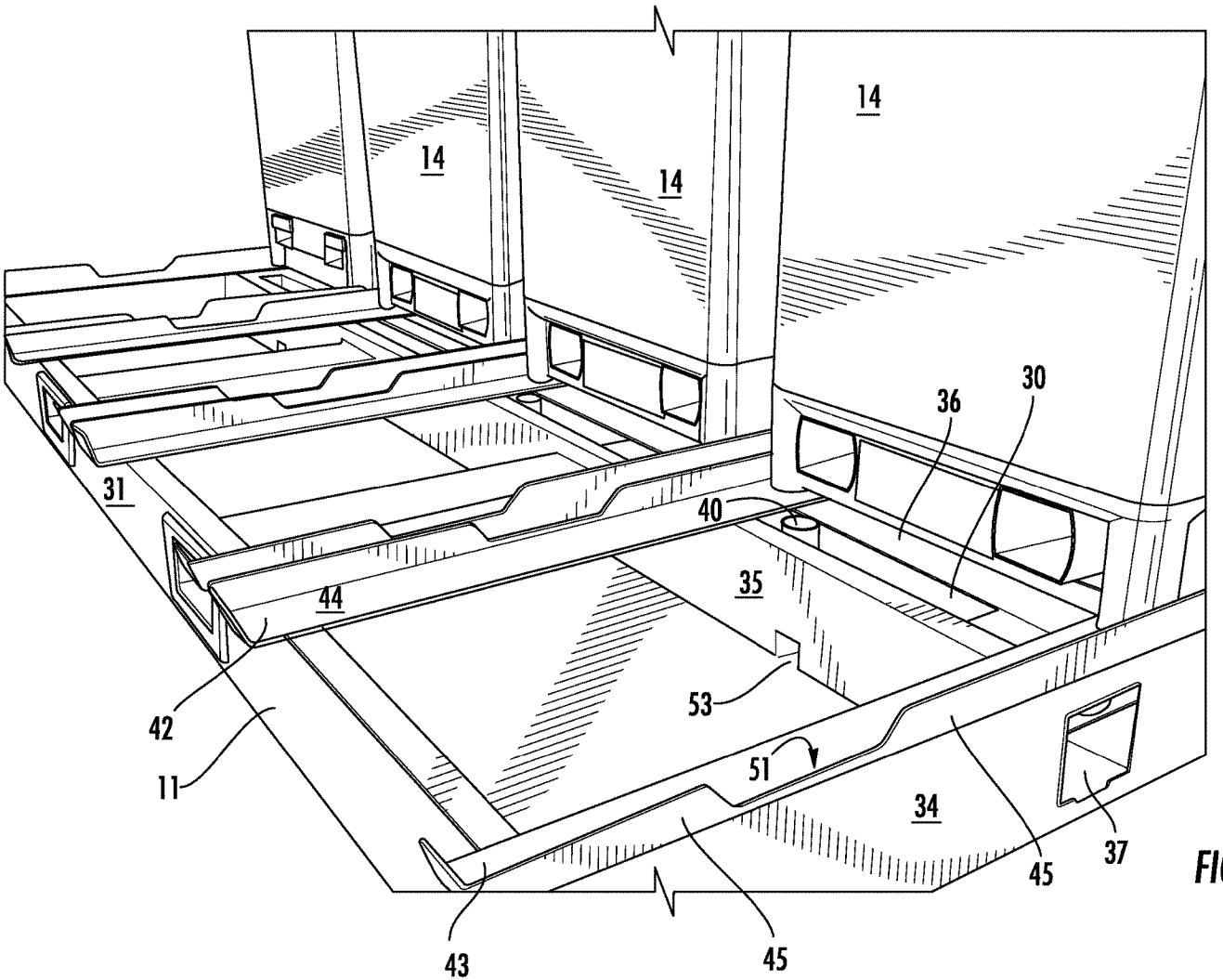
FIG. 16 is partial perspective view of a preferred embodiment of the apparatus of the present invention.
Figure 17:
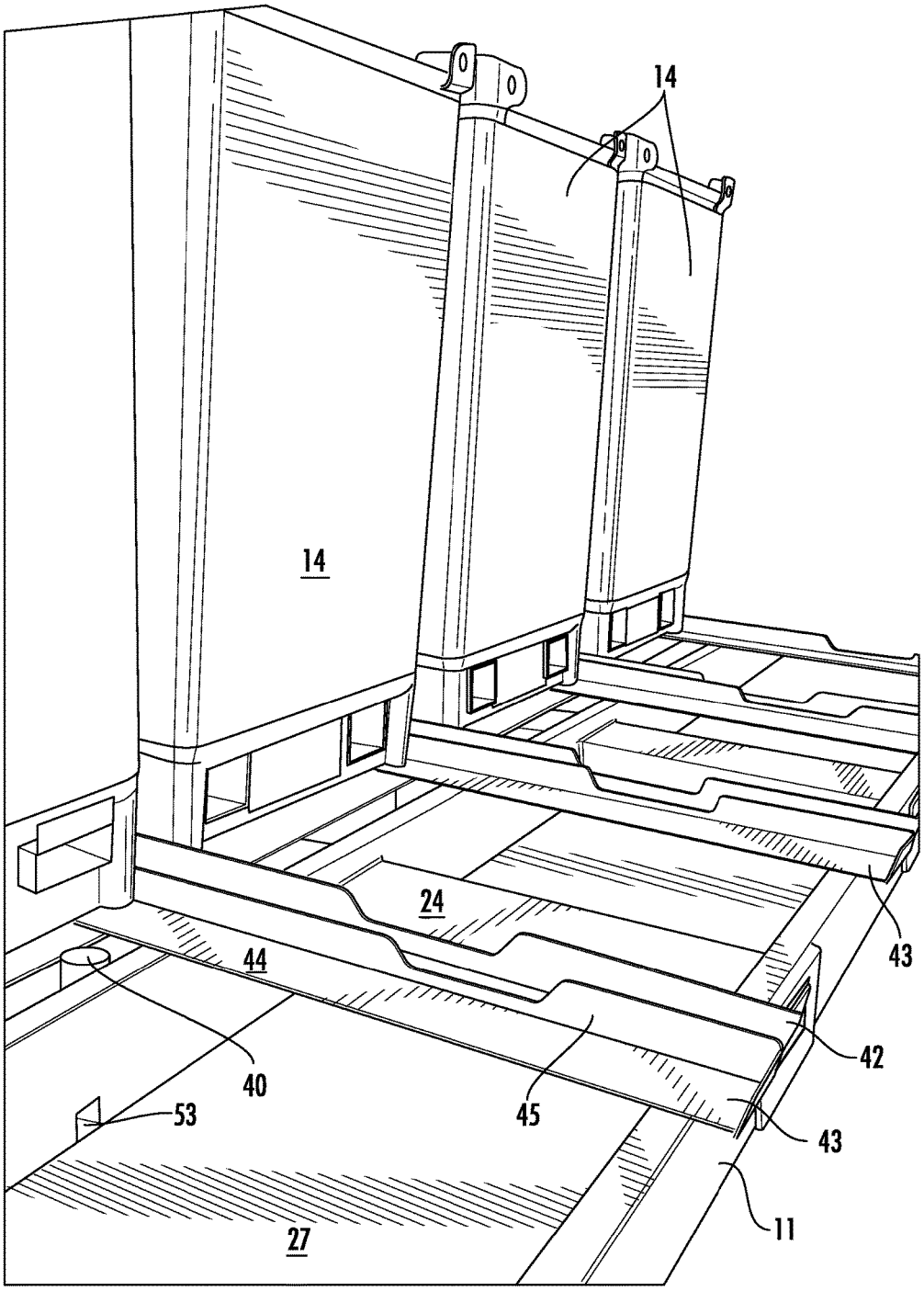
FIG. 17 is partial perspective view of a preferred embodiment of the apparatus of the present invention.
Figure 18:
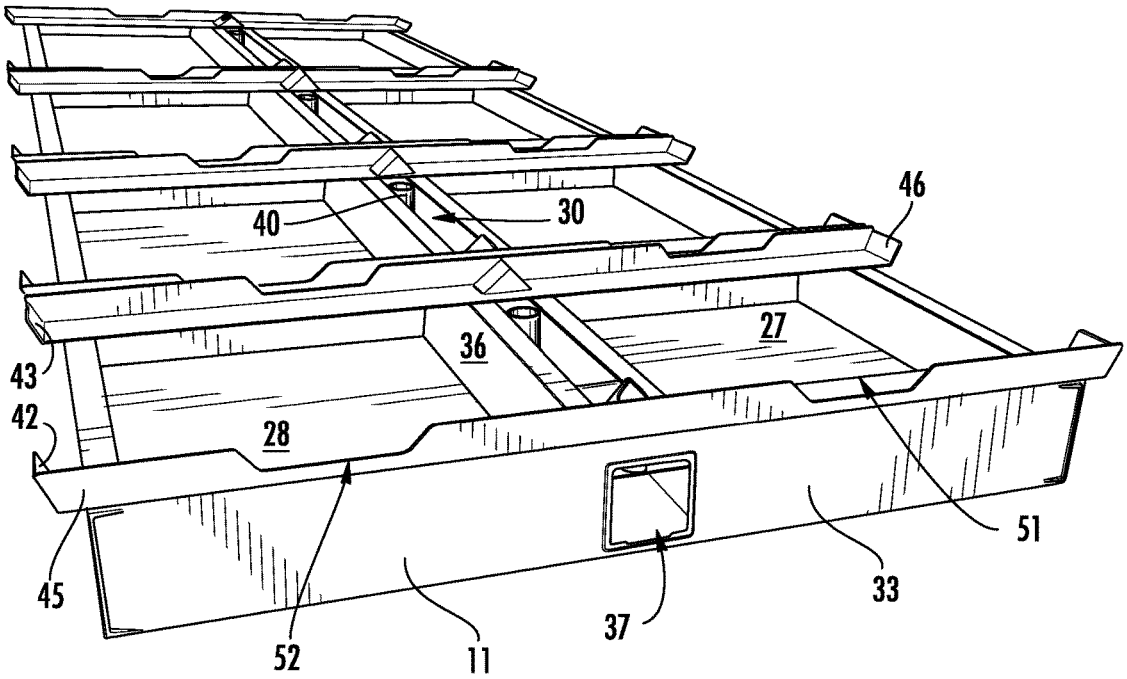
FIG. 18 is perspective view of a preferred embodiment of the apparatus of the present invention.
Figure 19:
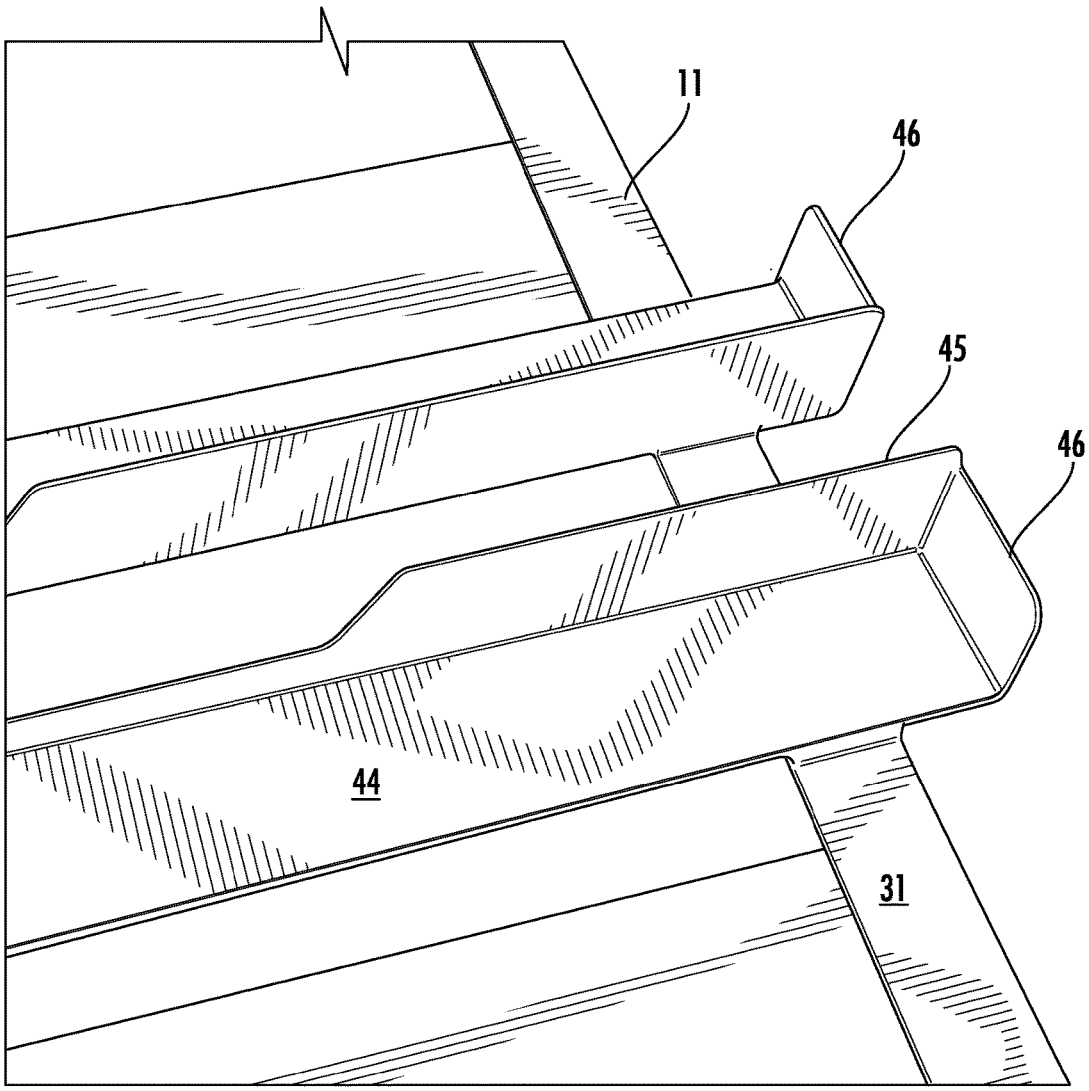
FIG. 19 is partial perspective view of a preferred embodiment of the apparatus of the present invention.
Figure 20:
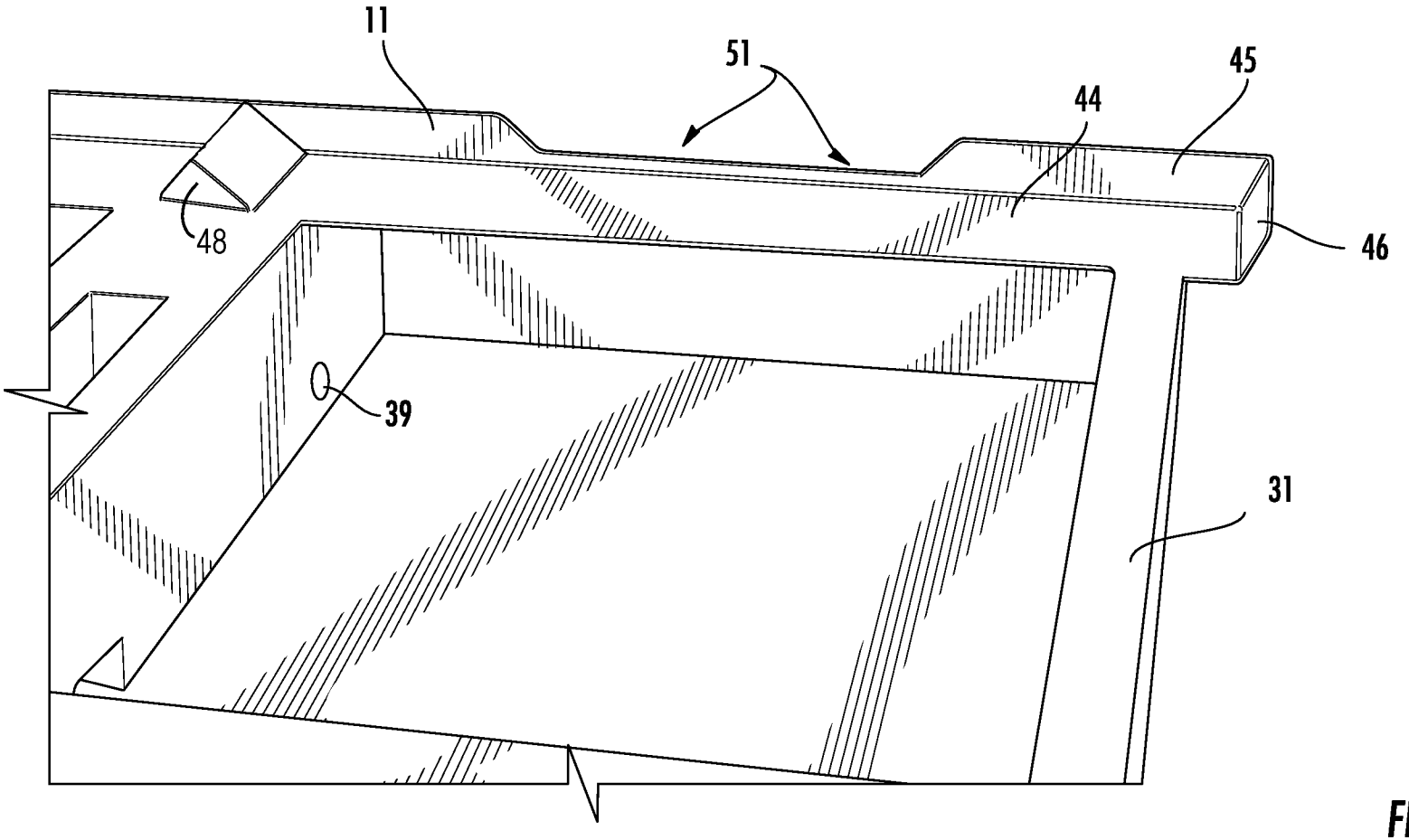
FIG. 20 is partial perspective view of a preferred embodiment of the apparatus of the present invention.
Figure 21:
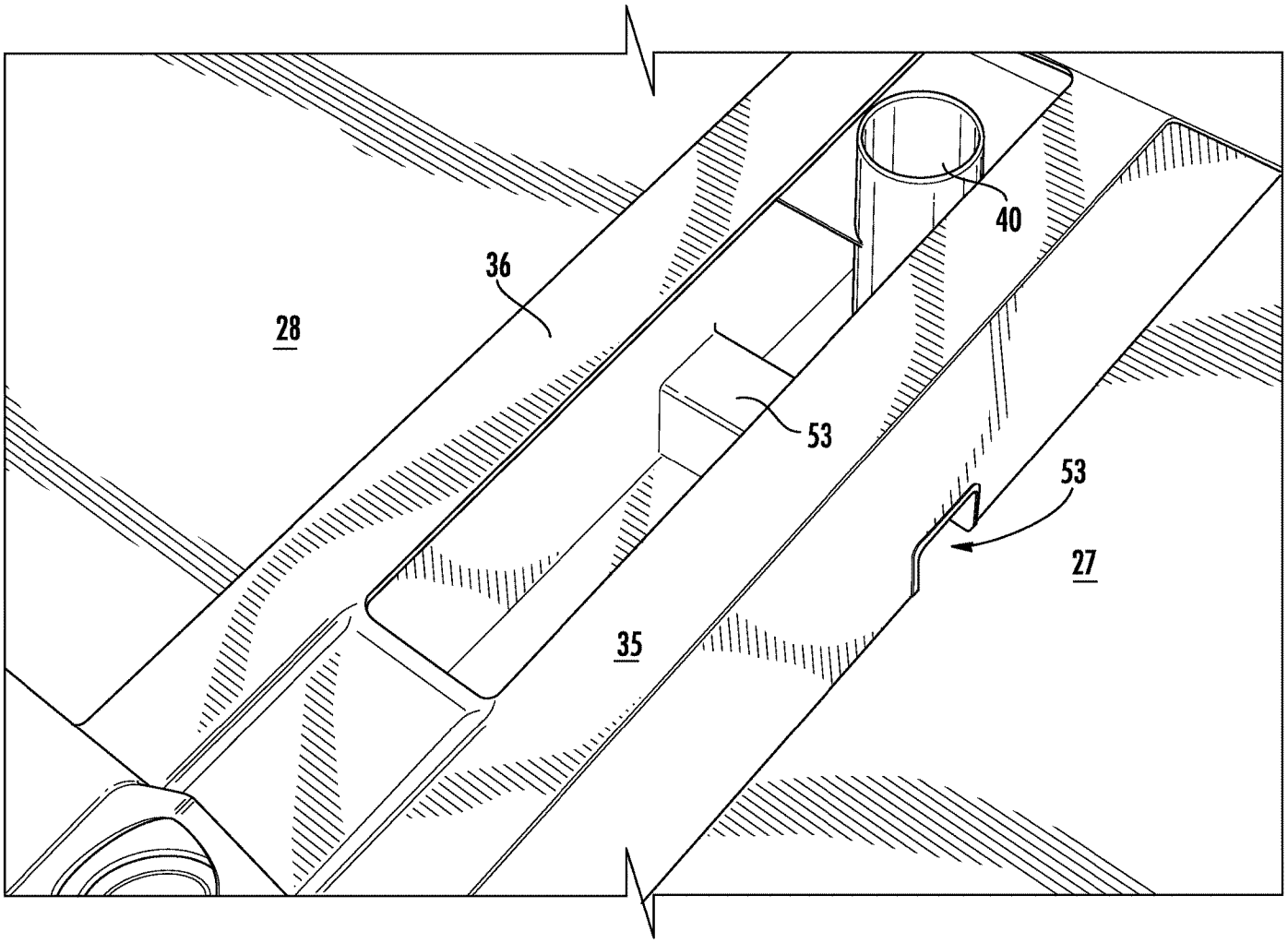
FIG. 21 is partial perspective view of a preferred embodiment of the apparatus of the present invention.
Figure 22:
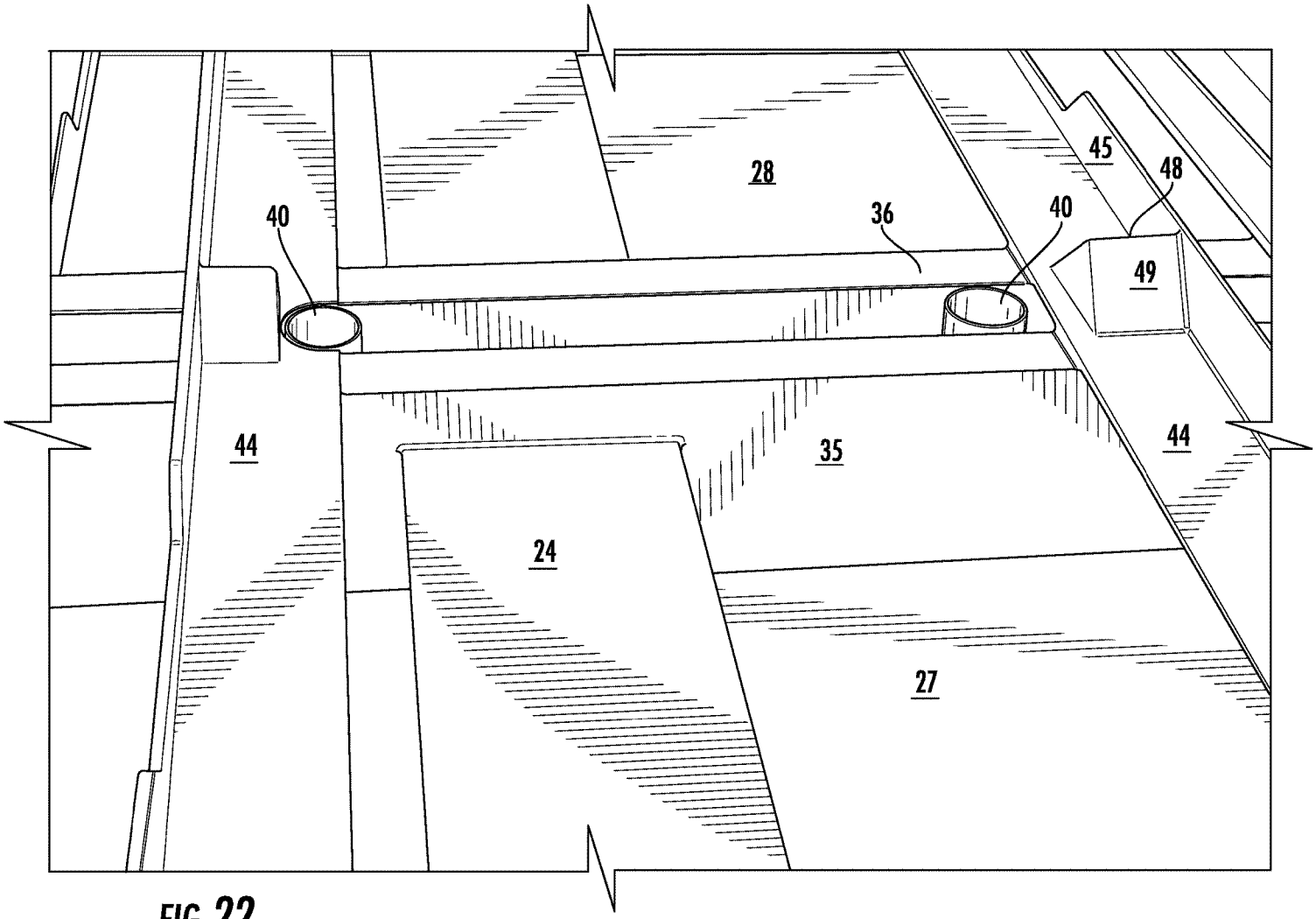
FIG. 22 is partial perspective view of a preferred embodiment of the apparatus of the present invention.
Figure 23:
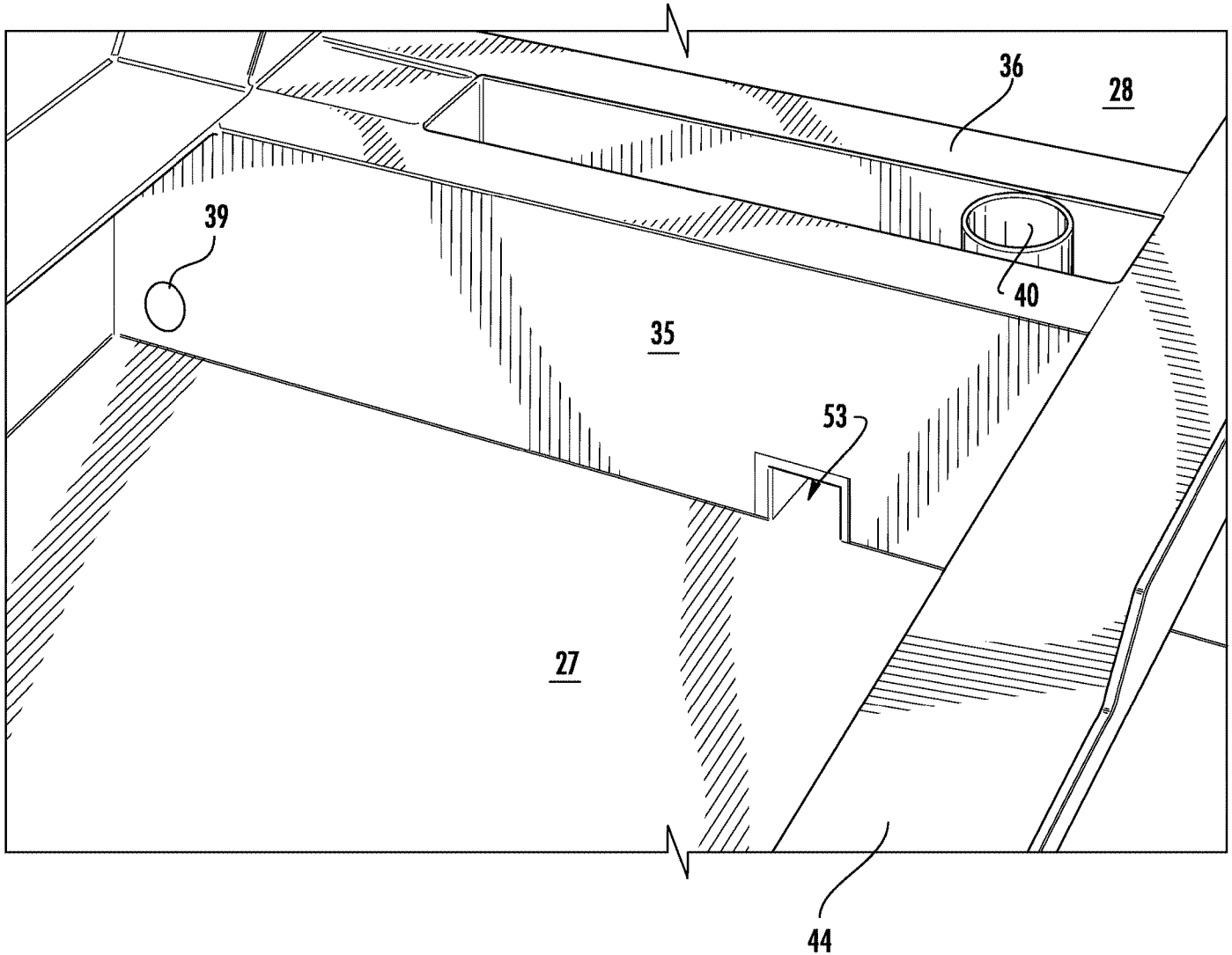
FIG. 23 is partial perspective view of a preferred embodiment of the apparatus of the present invention.

A plurality of tank receptacles 15-22 are preferably provided. These receptacles can preferably include a plurality of front receptacles 15, 16, 17, 18 forming a front row and a plurality of rear receptacles 19, 20, 21 and 22 forming a rear row (see FIG. 1). In one embodiment, a selected tank 14 can preferably be placed on a tank receptacle or tank position 15, 16, 17, 18 on the front row and preferably slid to a tank position or tank receptacle on the back row. For example, a tank 14 placed on tank receptacle or tank position 15 in FIG. 1 could be moved (slid) to the tank position 19 in FIG. 1. In FIG. 10, the tanks 14 are on a front row. In FIG. 14, the tanks 14 are on a back or rear row. The dimensions of each receptacle 15-22 can vary so that they are sized to mimic the dimensions of a tank 14. Tank 14 is preferably a commercially available tote having a volume of about 165-550 gallons (606-2,082 liters), more preferably about 550 gallons (2,082 liters). Tank 14 preferably has a length of about 48 inches (122 centimeters) and preferably has a width of about 42 inches (107 centimeters). Tank 14 preferably has a height of about 36 inches to 77 inches (91-196 centimeters); more preferably about 53 inches to 77 inches (135-196 centimeters); and most preferably about 77 inches (196 centimeters). In a preferred embodiment, each receptacle 15-22 preferably has the same dimensions, which are dependent upon the dimensions of the tanks 14 that will be supported by the apparatus of the present invention.

Figure 6:
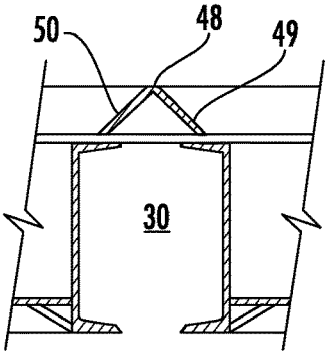
FIG. 6 is a sectional view taken along lines 6-6 of FIG. 1.
Figure 7:
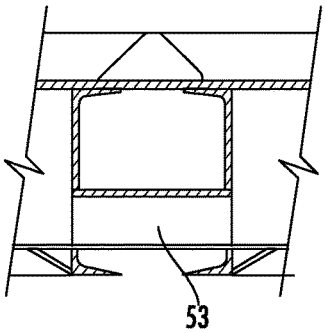
FIG. 7 is a sectional view taken along lines 7-7 of FIG. 1.
Figure 8:
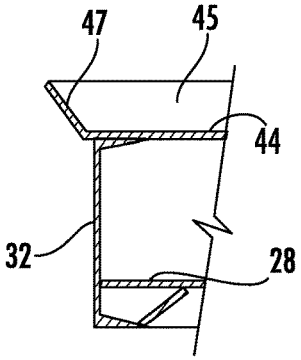
FIG. 8 is a sectional view taken along lines 8-8 of FIG. 1.
Figure 9:
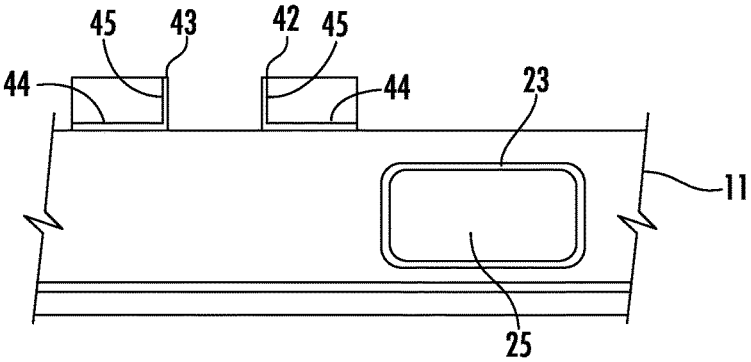
FIG. 9 is a sectional view taken along lines 9-9 of FIG. 1.
Figure 12:
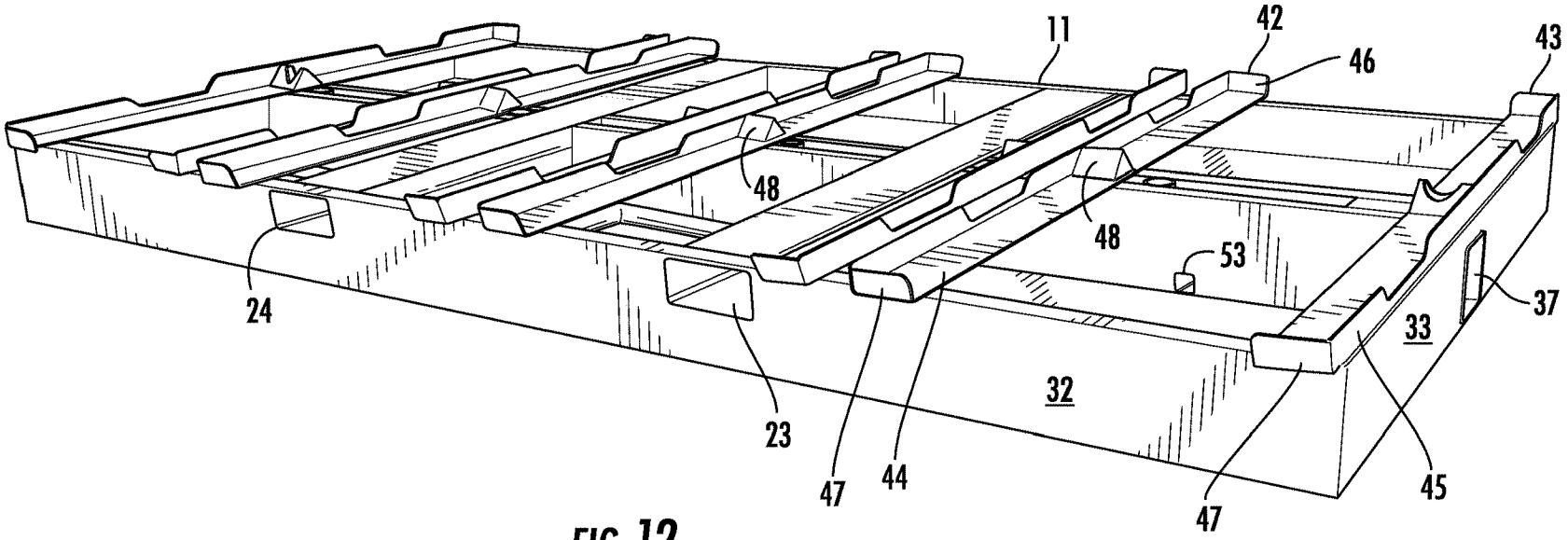
FIG. 12 is a perspective view of a preferred embodiment of the apparatus of the present invention.
Figure 13:
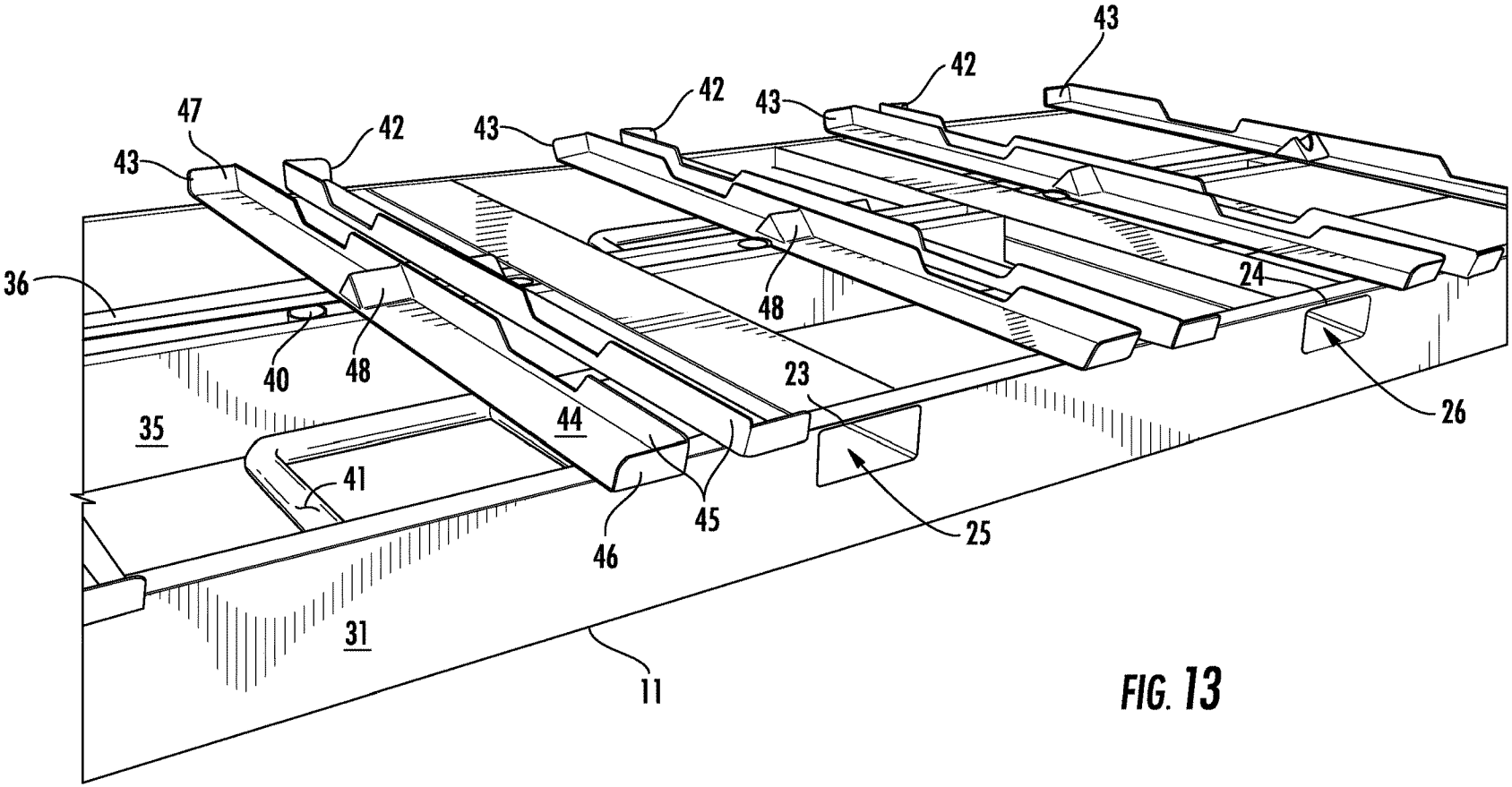
FIG. 13 is a partial perspective view of a preferred embodiment of the apparatus of the present invention.

In one embodiment, there is preferably stop(s) 48 which makes sliding the tanks 14 not possible (see FIGS. 6, 12).

In one embodiment, frame 11 can have forklift tine tubes or sockets 23, 24 so that a forklift can pick up and move the frame 11. In one embodiment, the forklift tine tubes or sockets 23, 24 preferably have a width that mimics the width of the tank support and transport skid apparatus 10. The forklift tine tubes or sockets 23, 24 can have a length of about 12 inches (30.48 centimeters) and a height of about 6 inches (15.24 centimeters). One tank 14 can preferably be placed on each receptacle 15-22. Each forklift tine tube 23, 24 preferably has a bore or opening 25 or 26 (see FIG. 2).

The frame 11 preferably provides a pair of floor sections 27, 28 that define an overall floor below receptacles 15-22. The dimensions of each floor section 27, 28 can vary so that they are sized to mimic the dimensions of a tank 14. In a preferred embodiment, each floor section 27, 28 can have the same dimensions, which are dependent upon the dimensions of the tanks 14 that will be supported by the apparatus of the present invention. The floor sections 27, 28 preferably each incline to direct fluid flow toward a pipe or channel 30 (see FIG. 3). In one embodiment, pipe 30 is preferably made out of channel iron or other suitable material. Each pipe or channel 30 can preferably be generally parallel to the front and rear of the frame 11. Pipe/channel 30 preferably runs the length of frame 11, as seen in FIG. 1. Frame 11 can preferably be generally rectangular, providing perimeter 29. The perimeter 29 can be defined by front beam or panel 31, rear beam or panel 32 and side beams or panels 33, 34. Each of the beams or panels 31, 32, 33, 34 can preferably be flanged beams, channel beams, I-beams, reinforced plate or other suitable beams. In one embodiment, each of the panels 31, 32 has a height of about 15 inches (38.1 centimeters). In one embodiment, each of the panels 33, 34 has a height of about 15 inches (38.1 centimeters).

Internal or interior supports or support beams or walls 35, 36 are placed internally such as preferably in between front and rear beams/panels 31, 32 or in between side beams or panels 33, 34. In one embodiment, internal wall 35 has a length that mimics the length of the apparatus 10 and can be located about 44.5 inches (113.03 centimeters) from front beam 31, and internal wall 36 has a length that mimics the length of the apparatus 10 and is located about 44.5 inches (113.03 centimeters) from rear beam 32, with a distance of about 8.5 inches (21.59 centimeters) between internal wall 35 and internal wall 36. Pipes or channels 30 each preferably span between internal or interior supports, beams, walls 35, 36 at a side portion such as next to side beams 33 or 34 (see FIGS. 11, 18, 21-26).

Figure 24:
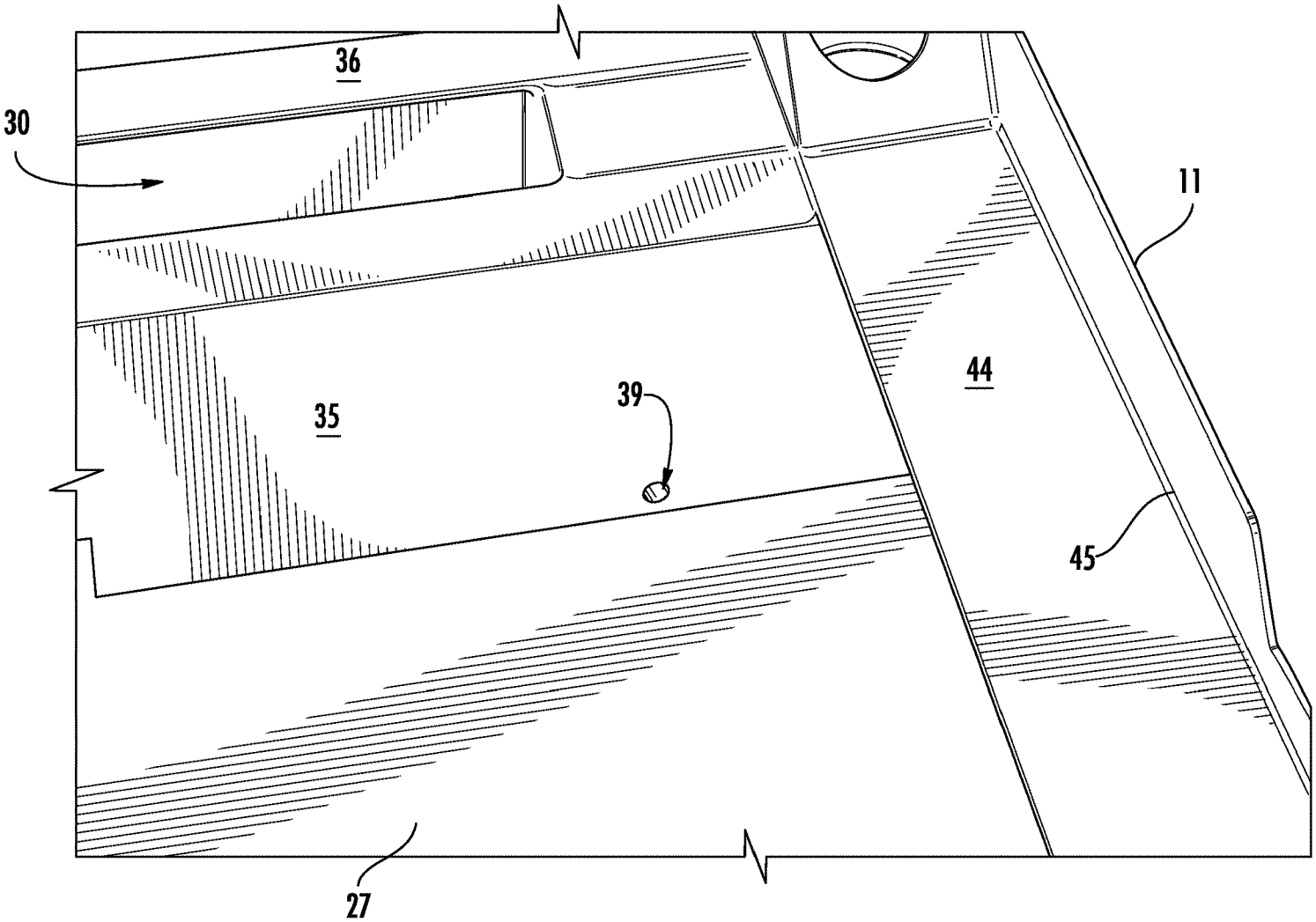
FIG. 24 is partial perspective view of a preferred embodiment of the apparatus of the present invention.
Figure 25:
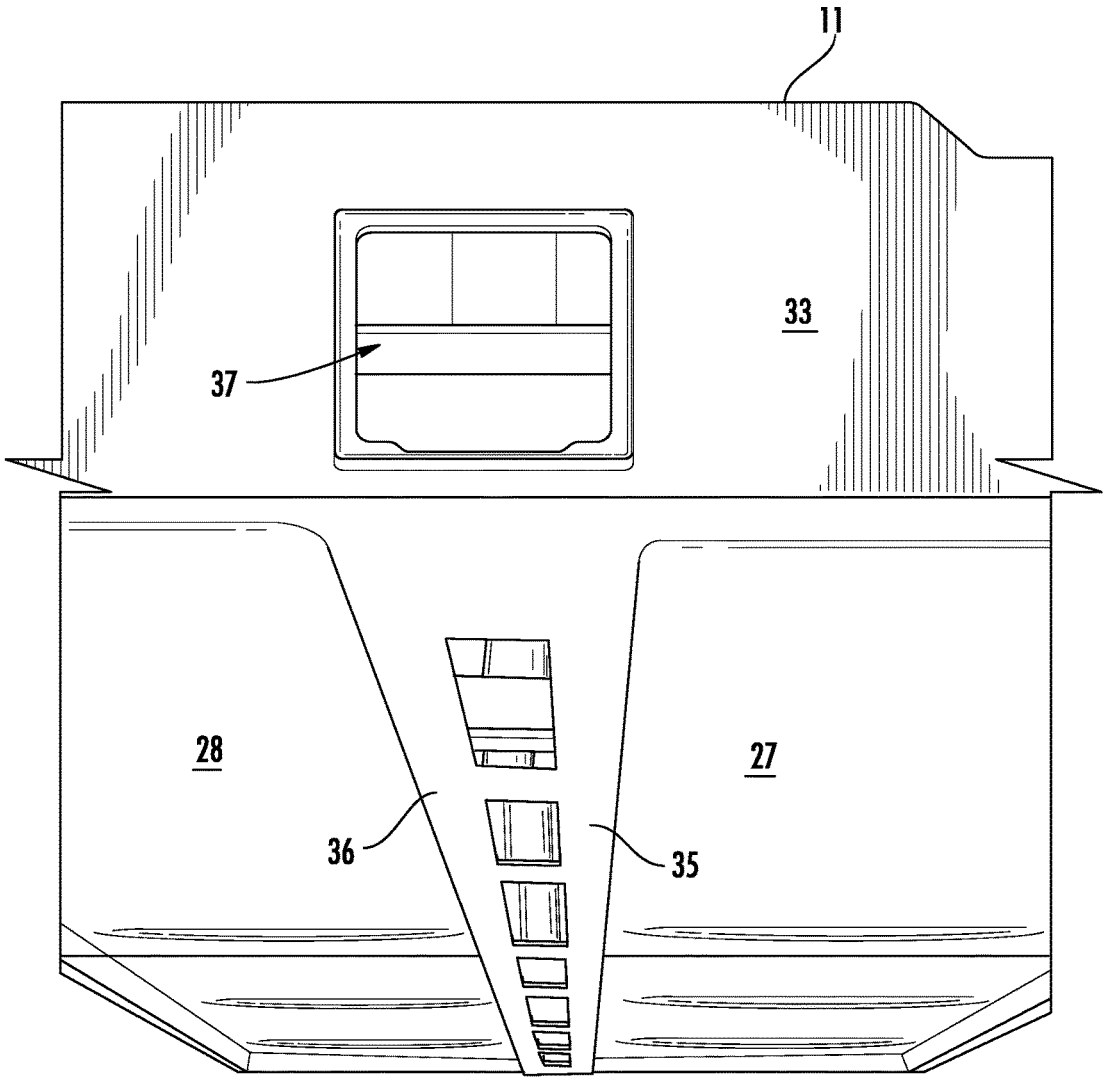
FIG. 25 is partial bottom perspective view of a preferred embodiment of the apparatus of the present invention.
Figure 26:
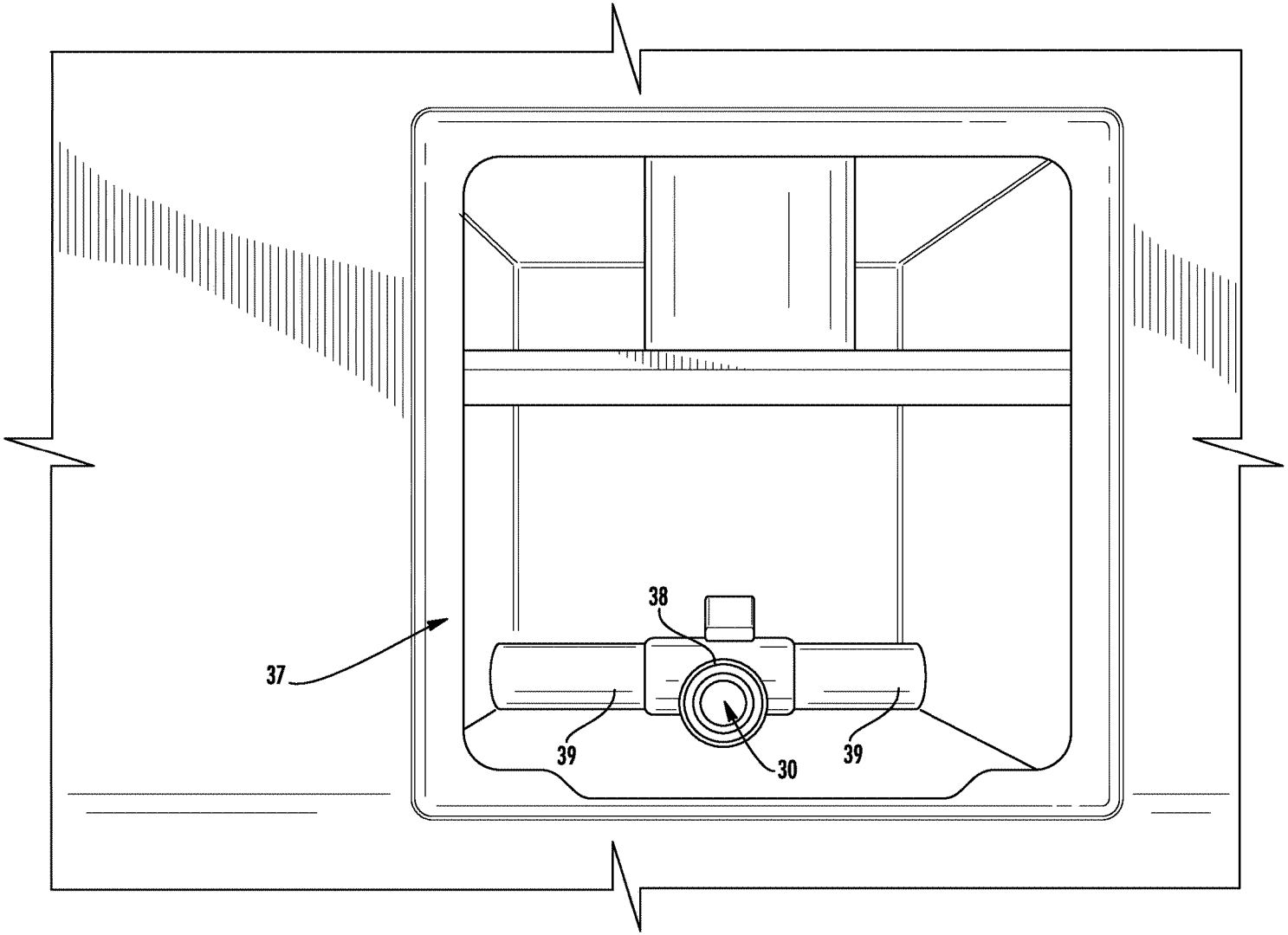
FIG. 26 is partial perspective view of a preferred embodiment of the apparatus of the present invention.

Openings or ports 39, preferably in beams or walls 35, 36, preferably enable fluid flow from floor sections 27, 28 to a pipe or channel 30 (see FIG. 24). In one embodiment, port 39 preferably has a diameter of about 4 inches (10.16 centimeters).

At either or both ends of internal supports 35, 36 there preferably can be provided an opening 37 preferably having a valved outlet 38 that receives flow preferably from a port 39 that is preferably in fluid communication with pipe or channel 30 (see FIGS. 4, 11, 24 and 26). In one embodiment, opening 37 is about 11.25 inches by 5.25 inches (28.58 centimeters by 13.34 centimeters).

In one embodiment, passages 53 can be provided that enable fluid flow from preferably one floor section 27 to the other floor section 28 (see FIGS. 7, 12, 14, 16, 21, 23). In one embodiment, passages 53 are each preferably about 2 inches by 2 inches (5.08 centimeters by 5.08 centimeters). Passages 53 preferably flow into channel 30. Each floor section 27, 28 is preferably inclined to direct flow of fluid toward a pipe or channel 30 and its opening or port 39. Such a pipe or channel 30 can be provided preferably at each end of frame 11, one near each side beam 33, 34.

Figure 5:
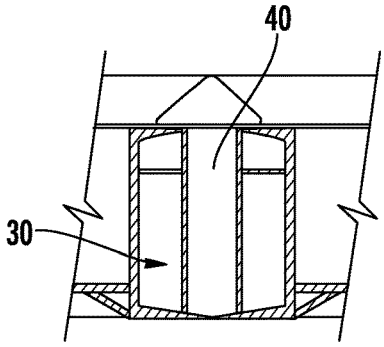
FIG. 5 is a sectional view taken along lines 5-5 of FIG. 1.
Figure 11:
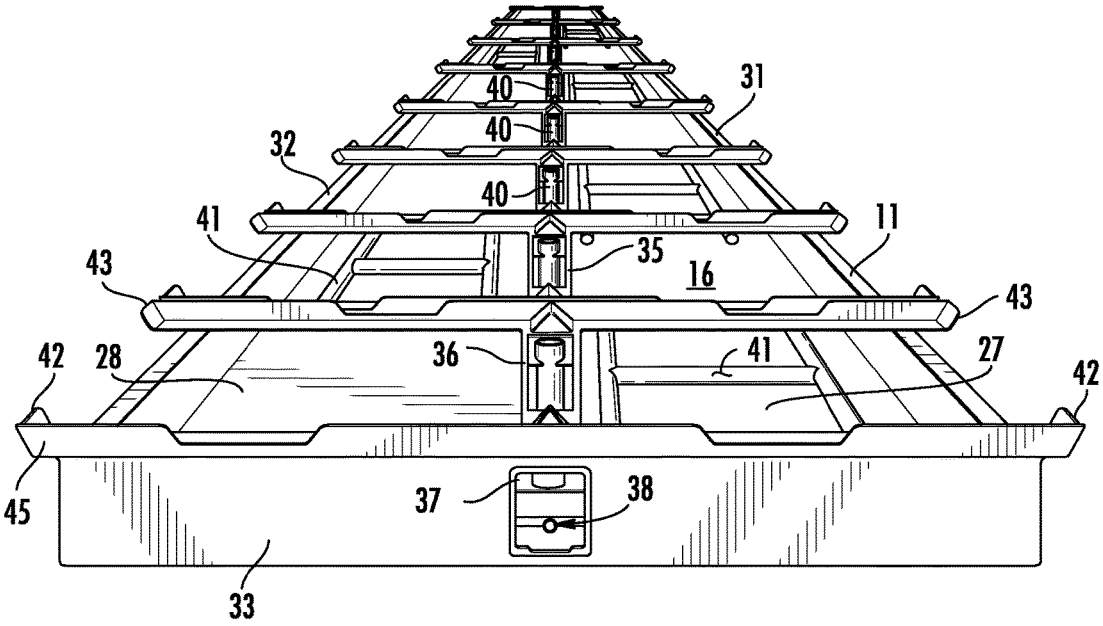
FIG. 11 is an end perspective view of a preferred embodiment of the apparatus of the present invention.

Vertically positioned tubes 40 can preferably be provided at spaced intervals as seen in FIGS. 1, 5. The tubes 40 are preferably made out of stainless steel or other suitable material. These tubes 40 can preferably be receptive of hand rails 41 (see FIGS. 11 and 13). Hand rails 41 preferably slide into tubes 40. Hand rails are preferably stored on floor sections 27, 28, as seen in FIG. 11.

Each tank receptacle 15-22 can preferably be supported by a left tank support beam or rail 42 and a right tank support beam or rail 43. Each support beam or rail 42, 43 preferably includes horizontal member or slide 44, inclined side member 45, inclined end members 46, 47 (see FIGS. 3, 8, 9, 10,12). In one embodiment, inclined end members 46, 47 are preferably about 3 inches (7.62 centimeters) tall, about 6 feet (1.83 meters) long, and about 3 inches (7.62 centimeters) high.

In one embodiment, there is at least one stop or divider 48. Stop 48 can preferably have opposed inclined surfaces 49, 50. Stop 48 is preferably positioned above channel 30 (see FIGS. 6, 11-13). In one embodiment, each stop 48 preferably has dimensions of about 6 inches (15.24 centimeters) long, about 6 inches (15.24 centimeters) wide, and about 4 inches (10.16 centimeters) high.

Each inclined side member 45 can preferably have cut outs or recesses 51, 52 (see FIG. 3) enabling access to piping/valving or other fittings next to the bottom of a selected tank 14. In one embodiment, inclined side members 45 are preferably about 6 inches (15.24 centimeters) wide, about 8 feet 7 inches (2.61 meters) long, and about 3 inches (7.62 centimeters) high with recesses 51, 52 preferably with a length of about 12 inches (30.48 centimeters), and a height of preferably about 2 inches (5.08 centimeters).

In a preferred embodiment, there are no stops or dividers 48 so that a selected tank 14 can slide upon horizontal member/plate/slide 44 from a front row position next to front beam/panel 31 to a rear row position next to rear beam/panel 32.

The following is a list of parts and materials suitable for use in the present invention:

| PARTS LIST: | |
|---|---|
| PART NUMBER | DESCRIPTION |
| 10 | tank support and transport skid apparatus |
| 11 | frame |
| 12 | bottom |
| 13 | upper area |
| 14 | tank |
| 15 | tank receptacle/tank position |
| 16 | tank receptacle/tank position |
| 17 | tank receptacle/tank position |
| 18 | tank receptacle/tank position |
| 19 | tank receptacle/tank position |
| 20 | tank receptacle/tank position |
| 21 | tank receptacle/tank position |
| 22 | tank receptacle/tank position |
| 23 | forklift tine tube |
| 24 | forklift tine tube |
| 25 | bore/socket |
| 26 | bore/socket |
| 27 | first floor section |
| 28 | second floor section |
| 29 | perimeter |
| 30 | pipe/channel |
| 31 | front beam/panel |
| 32 | rear beam/panel |
| 33 | side beam/panel |
| 34 | side beam/panel |
| 35 | first interior support/wall/beam |
| 36 | second interior support/wall/beam |
| 37 | opening |
| 38 | valved outlet/valve |
| 39 | opening/port |
| 40 | tube |
| 41 | hand rail |
| 42 | left tank support beam/rail |
| 43 | right tank support beam/rail |
| 44 | horizontal member/plate/slide |
| 45 | inclined side member/plate |
| 46 | inclined end member/plate |
| 47 | inclined end member/plate |
| 48 | stop/divider |
| 49 | surface |
| 50 | surface |
| 51 | recess |
| 52 | recess |
| 53 | passage |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A tank support base and skid apparatus comprising:

a) a frame having upper and lower end portions, left and right side portions and front and rear portions;

b) the upper end portion having a front row of tank receptive supports and a back row of tank receptive supports;

c) a frame floor that is spaced vertically below said tank receptive support;

d) the frame having a peripheral fluid barrier that includes a front wall, a rear wall and side walls that form the said fluid barrier around said floor, each said side wall extending from said floor to said tank receptive support;

e) first and second internal support members that span from one side of said frame to the other side of said frame and each spaced between the front wall and the rear wall;

f) each tank receptive support including:

horizontal beams that span from the front wall to the rear wall and are supported by the internal support members;

vertical members that each connect with a horizontal beam;

inclined plates that each connect to both said horizontal beam and said vertical member; and g) stops mounted on the beams that separate a tank receptive support of the first row with a tank receptive support of the back row.

2. The apparatus of claim 1 wherein each stop is positioned above said internal support members.

3. The apparatus of claim 1 wherein inclined plates form an obtuse angle with the horizontal beams.

4. The apparatus of claim 1 further comprising forklift tine sockets in between the upper and lower end portions of the frame and extending to the front wall.

5. The apparatus of claim 1 wherein the stops each include opposed inclined surfaces that meet an apex edge.

6. The apparatus of claim 1 further comprising tubes at spaced apart intervals each mounted in between two said internal support members.

7. The apparatus of claim 1 wherein said internal supports define a channel therebetween and the floor is inclined to direct fluid flow to said channel.

8. The apparatus of claim 1 wherein both the stops and the inclined plates provide inclined, diagonally angled upper surfaces that each form an obtuse angle with a said horizontal beam.

9. The apparatus of claim 1 further comprising a plurality of fluid storage tanks on the frame, each tank on a tank receptive support.

10. The apparatus of claim 9 wherein each tank has a lower end portion with discharge piping.

11. The apparatus of claim 10 wherein each vertical member has a cut out that is placed in between the front wall and an internal support.

12. The apparatus of claim 11 wherein each cutout is next to a tank discharge piping.

13. A tank support base and skid apparatus comprising:

a) a frame having upper and lower end portions, left and right side portions and front and rear portions and a frame periphery;

b) the upper end portion having a plurality of tank receptive supports;

c) a frame floor that is spaced vertically below said tank receptive supports;

d) the frame having a peripheral fluid barrier that includes a front wall, a rear wall and side walls that form the said fluid barrier around said floor, each said side wall extending from said floor to said tank receptive support;

e) first and second internal support members that span from one side of said frame to the other side of said frame;

f) a channel in between the internal support members;

g) channel openings that transmit any spilled fluid from the floor to the channel; and h) channel openings that allow any spilled fluid from the floor to drain to the channel; and i) each tank receptive support including:
horizontal beams that span from the front wall to the rear wall and supported by the internal support members;
vertical members that each connect with a horizontal beam;
inclined plates that each connect to both said horizontal beam and said vertical member.

14. The apparatus of claim 13 further comprising dividers positioned above said internal support members.

15. The apparatus of claim 13 further comprising forklift tine sockets in between the upper and lower end portions of the frame and extending to the front wall.

16. The apparatus of claim 13 further comprising tubes at spaced apart intervals each mounted in between two said internal support members.

17. The apparatus of claim 13 wherein said internal supports define a channel therebetween and the floor is inclined to direct fluid flow to said channel.

18. The apparatus of claim 17 further comprising multiple spaced apart openings in the internal supports at a position next to the floor.

19. The apparatus of claim 14 wherein both the dividers and the inclined plates provide inclined, diagonally angled upper surfaces that each form an obtuse angle with a said horizontal beam.

20. The apparatus of claim 13 wherein each vertical member has a cut out that is placed in between the front wall and an internal support.

21. The apparatus of claim 13 further comprising a plurality of fluid storage tanks on the frame, each tank on a tank receptive support.

22. The apparatus of claim 21 wherein each tank has a lower end portion with discharge piping.

* * * * *